US005593213A

United States Patent [19]

Meessmann

[11] Patent Number: 5,593,213

[45] Date of Patent: Jan. 14, 1997

[54] BRISTLE FINISHING FORK

[75] Inventor: Jeffrey S. Meessmann, Iowa City, Iowa

[73] Assignee: Gillette Canada Inc., Kirkland, Canada

[21] Appl. No.: 209,189

[22] Filed: Mar. 11, 1994

[51] Int. Cl.[6] ..... A46D 1/04; A46D 9/00

[52] U.S. Cl. ..... 300/21; 300/11; 300/17

[58] Field of Search ..... 300/2, 10, 11, 300/17, 18, 21

[56] References Cited

U.S. PATENT DOCUMENTS

| | | | |
|---|---|---|---|
| 132,031 | 10/1872 | Stone . | |
| 2,227,126 | 12/1940 | Cooke | 51/281 |
| 2,426,328 | 8/1947 | Wandel et al. | 300/21 |
| 3,233,943 | 2/1966 | Peterson | 300/17 |
| 3,451,173 | 6/1969 | Hazelton | 51/110 |
| 5,143,425 | 9/1992 | Boucherie | 300/2 |
| 5,165,761 | 11/1992 | Dirksing | 300/21 |
| 5,176,427 | 1/1993 | Weihrauch | 300/10 |
| 5,344,218 | 9/1994 | Weihrauch | 300/2 |

FOREIGN PATENT DOCUMENTS

| | | | |
|---|---|---|---|
| 0078569 | 1/1988 | European Pat. Off. . | |
| 1931527 | 11/1965 | German Dem. Rep. . | |
| 84741 | 1/1896 | Germany | 300/17 |
| 1532773 | 1/1971 | Germany . | |
| 3415870 | 10/1985 | Germany . | |

OTHER PUBLICATIONS

Bass, Optimum Characteristics of Toothbrushes for Personal Hygiene, Dent. Items Interest, vol. 70, pp. 697–718 (1948).

Silver Stone & Featherston, Examining the end rounding pattern of toothbrush bristles . . . , Gerodentics, 4:2, pp. 45–62 (1988).

Nyguard et al., Access to Interproximal tooth surfaces by different bristle designs and stiffnesses of toothbrushes, Scand. J. Res., 87: 24–430 (1979).

*Primary Examiner*—John M. Husar

*Attorney, Agent, or Firm*—Chester Cekala

[57] ABSTRACT

The present invention relates to a bristle finishing fork for isolating bristles affixed to a toothbrush head within a bristle finishing region comprising two elongated prongs having tips spaced at a distance "A" defining the width of the bristle swath to be isolated, wherein starting at said tip, the distance between the prongs increases to a distance "B" defining the sidewall of the bristle finishing region. The present invention still further relates to a device for isolating and end-rounding bristles affixed to a toothbrush head within a bristle finishing region comprising: (a) a means for holding a toothbrush with bristles affixed thereto; and (b) a bristle finishing fork comprising two elongated prongs having tips spaced at a distance "A" defining the width of the bristle swath to be isolated, wherein starting at said tip, the distance between the blades increases to a distance "B" defining the sidewall of the bristle finishing region, whereby said fork has a backwards and forwards motion, in such a way that the tip of said prongs can be introduced between toothbrush bristles through a parallel relative motion between fork and brush, so that the swath of bristles to be isolated are positioned in said bristle finishing region; and (c) a means for rounding the distal ends of the bristles positioned in said bristle finishing region.

19 Claims, 6 Drawing Sheets

BRISTLE FINISHING FORK

FIELD OF THE INVENTION

The present invention relates to a device for isolating bristles affixed to a toothbrush head and finishing the free ends of said bristles into a generally rounded form. In particular, the present invention pertains to a bristle separating fork for use in bristle-end finishing operations which impart improved end-roundedness of the finished bristles. Furthermore, the present invention relates to a device for isolating and end-rounding bristles affixed to a toothbrush head.

BACKGROUND OF THE INVENTION

The use of brushes to clean teeth is a generally accepted means of maintaining oral hygiene. Consequently, many different styles and types of toothbrushes are either disclosed in the art or available in the market. Different combinations of bristle stiffness, handle design, brush head profile, bristle contour and the like provide varying degrees of cleaning, comfort, and, unfortunately, tooth and gum tissue damage.

It is generally known that toothbrushes with contoured bristle heights, can enhance the performance of a toothbrush. Toothbrushes with sinusoidal or serated bristle height patterns have been used, as well as various stepped and smoothed bristle trimming patterns.

It is also generally known that end-rounding of individual bristles reduces tooth and gum tissue damage by removing the sharp edges which result from the bristle trimming operation. See, for example, Bass, The Optimum Characteristics of Toothbrushes for Personal Oral Hygiene, Dent. Items Interest, Vol 70, pp. 697–718 (1948). Positioning the free ends of the bristles against an orbital grinder is a common and very effective means of achieving end rounding when the free ends of the bristles terminate within a common plane. See, for example, U.S. Pat. No. 3,451,173 to Hazelton, issued Jun. 24, 1969, incorporated herein by reference. Unfortunately, contoured bristle patterns exhibit inferior end rounding when performed on a simple orbital grinder as described in the Hazelton patent. If a bristle grinder is set to end round the tallest bristles, the shorter bristles are not rounded to any significant degree. Conversely, grinder penetration sufficient to end round the shorter bristles damages and distorts the ends and the side wall of the longer bristles.

Complex grinding systems have been developed to attempt to end round bristles after they have been attached to the brush head and trimmed to the desired contour. For example, U.S. Pat. No. 2,227,126 issued to Cook on Dec. 31, 1940, discloses a complex combination of contoured grinding wheels, blades and oscillating motions used in an attempt to end round the tips of bristles which are not within a common plane.

It is also well-known in the brush manufacturing industry, that brushes which contain bristle tuft bundles of varying length can be processed on more than one machine. This has been accomplished by stuffing short bristle tuft bundles, trimming them to height and finishing the tips if desired, followed by incremental stuffing, cutting and finishing steps for each longer tuft bundle size. This procedure is slow, and very costly from a capital investment standpoint since several bristling machines are required on each production line.

U.S. Pat. No. 2,426,328 issued to Wandel et al. on Aug. 26, 1947 discloses a thermal process for end rounding bristles. Unfortunately, the thermal process, especially for a contoured brush pattern is a very random process.

Thickening of the bristle ends or fusion of the bristle ends to one another typically result. Both of these characteristics are undesirable in the finished toothbrush. Means to remove such thickenings or fusions, such as with steel brushes are disclosed. However, such removal techniques tend to produce bristle tufts wherein the tips of the individual bristles are no longer uniformly end rounded.

In the German registered design number 1 931 527 (assigned to E. Steinebrunner and Co. Machine Works) a device is described in which tooth brush bristles of a brush can be cut into different lengths without readjusting the machine. This requires a combination of two serated cutting heads, arranged one on top of the other. Therefore, two special serated cutting heads must be combined in a very specific way for each type of brush. A new type of brush with a different arrangement of high and low parts of the bristling material, requires a relatively tedious change in-the arrangement of the combined serated cutting heads, which is time consuming and can only be performed by expert technicians.

The most common, and cost effective method of processing toothbrushes with bristles of varying heights involves using a means of isolating bristles of a particular height during each processing step. Typically, this is done by way of a template, shield or plow to protect non-isolated bristles while the isolated ones are subjected to a processing step.

German Patent application 1 532 773 (assigned to Gottlieb Ebser) discloses a devise having an elongated deflection template (**7*h*) which is moved down upon the head of a toothbrush, deflecting the bristles it contacts away from the select rows of bristles to be isolated. Thus the isolated bristles could be processed without disturbing the deflected bristles. This patent also describes two catch plates (8*i* and 8*h***) which wrap around and hug the outer rows of bristles while they are cut to a specific height. This patent appears to be silent on the use of end rounding.

German patent 3 415 870 (assigned to Anton Zahoransky) discloses a machine for treating the tufts of bristles and brushes such as cutting or smoothing them down. In this process pressure is exerted on the outer ends of the longer tufts of bristles by means of a u-shaped cross-sectional pressure piece. (8). Thus, pushing the longer bristles over and leaving them contained within the u-shaped bristle-retaining pressure piece.

European patent 0 078 569 (assigned to G. B. Boucherie, n.v.) relates to a device for separating rows of brush tufts. The devise utilizes a fork-like separator with two knife-like prongs. The fork is introduced through a parallel motion between the knife and brush so that at least one row of brush tufts can be curved away to the side. Thus, the non-displaced bristles can be processed in a trimming and end rounding operation. Forks of this kind are not new in the toothbrush manufacturing art, U.S. Pat. No. 132, 031 to J. Stone (issued Oct. 8, 1872) describes a toothbrush trimmer which utilizes a forked bristle holder (E) to hold bristles to be treated in a trimming operation in place.

Finally, U.S. Pat. No. 5,143,425 discloses a devise for cutting bristles of a toothbrush to different lengths in different selected areas of a tuff pattern. This device utilizes a shield member which is moved down over the bristles to be isolated. The shield member also comprises a ramp means which helps to push or plow the bristles away from the isolated bristles.

Surprisingly, Applicant has discovered a new and improved toothbrush bristle displacing fork. This fork is particularly suited for toothbrush bristle end finishing operations, e.g., end rounding. Accordingly, it is an object of the present invention to provide a bristle finishing fork for rounding the ends of toothbrush bristles affixed to a head which have been trimmed to different heights.

It is a further object of the invention to provide a device which allows the separation of toothbrush bristles into finely delineated areas for bristle finishing.

It is further an object of the present invention to provide a device for isolating and end rounding bristles affixed to a toothbrush head wherein the bristles are cut to different lengths. This device isolates bristles of a particular length, finishes them and then incrementally isolates and then goes on to finish bristles of other lengths in subsequent incremental operations.

These and other objects will be clear from the following:

BRIEF SUMMARY OF THE INVENTION

The present invention relates to a bristle finishing fork for isolating bristles affixed to a toothbrush head within a bristle finishing region comprising two elongated prongs having tips spaced at a distance "A" defining the width of the bristle swath to be isolated, wherein starting at said tip, the distance between the prongs increases to a distance "B" defining the sidewall of the bristle finishing region.

The present invention also relates to a two prong bristle finishing fork comprising: (a) a base plate; (b) two elongated prongs having a tip end and terminal end, said prongs being connected to said base plate at their terminal ends, wherein said prongs are spaced at a distance "A" defining the width of the bristle swath to be isolated, wherein, starting at the tip of the prong, the distance between the blades increases to a distance "B".

The present invention still further relates to a device for isolating and end-rounding bristles affixed to a toothbrush head within a bristle finishing region comprising: (a) a means for holding a toothbrush with bristles affixed thereto; and (b) a bristle finishing fork comprising two elongated prongs having tips spaced at a distance "A" defining the width of the bristle swath to be isolated, wherein starting at said tip, the distance between the blades increases to a distance "B" defining the sidewall of the bristle finishing region, whereby said fork has a backwards and forwards motion, in such a way that the tip of said prongs can be introduced between toothbrush bristles through a parallel relative motion between fork and brush, so that the swath of bristles to be isolated are positioned in said bristle finishing region; and (c) a means for rounding the distal ends of the bristles positioned in said bristle finishing region.

Also, the present invention relates to a method of isolating and end-rounding a particular region of bristles which have been affixed to a toothbrush head.

BRIEF DESCRIPTION OF THE DRAWINGS

While the Specification concludes with claims that particularly point out and claim the subject matter regarded as forming the present invention, it is believed that the invention will be better understood from the following description and drawings in which

DETAILED DESCRIPTION OF THE INVENTION

Figure 1:
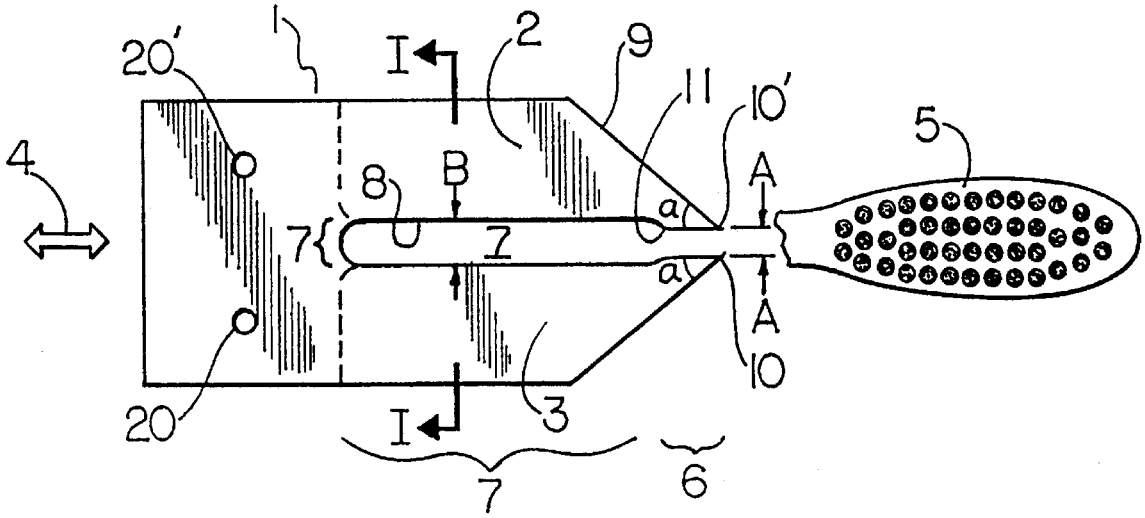
FIG. 1 is an elevated top view of a bristle finishing fork according to the present invention.

FIG. 1 depicts a bristle finishing fork 1 according to the present invention. The fork is comprised of two elongated prongs, 2 and 3, having tips, 10 and 10' spaced at a distance "A". During operation this fork has a backwards and forwards motion relative to a toothbrush head 5, as depicted by arrow 4, in such a way that the tips 10 and 10' of said prongs 2 and 3 can be introduced between is toothbrush bristles through a parallel relative motion between fork 1 and brush 5. The prongs, 2 and 3, are generally divided into a penetration region 6 and a bristle finishing region 7. These prongs are further comprised of an inner blade edge surface 8 and an outer blade edge surface 9 wherein the outer bladed surfaces are effective at plowing bristles away from the bristle finishing region. As can be seen from FIGS. 1 and 2, the inner blade edge surface 8 and the outer blade edge 9 surface intersect at the tips 10 and 10' of the prong. Further, it is the tip-to-tip (10-to-10') spacing which defines distance A.

An important feature of the present invention lies in the characteristic that the distance between the prongs increases away from the tip to a distance "B" defining the side wall of the bristle finishing region. Applicants have discovered that by increasing this distance the bristles are allowed to sway during the end rounding process; thus providing improved rounding of the bristle ends. To aid in the transition of the bristle through the penetration region and into the finishing region, and vice versa, an arching transition 11 is preferably utilized between the penetration region 6 and finishing regions 7.

As can be seen from the Figures, the inner blade edge surface 8 and the outer blade edge surface 9, intersect at the tip 10 to form an acute angle α. Preferably, the inner blade edge surface 8 and the outer blade edge surface 9 intersect at the tip 10 to form an angle of about 50 degrees (α).

The base plate 12 has two holes, 20 and 20', which are used as an affixing means for the fork. Any means of affixing known to those skilled in the art can be used. Typically, the fork is affixed to a sliding camlike member or to a mechanical insertion device such as a pneumatic drive, an electric drive or a magnetic drive.

Figure 2:
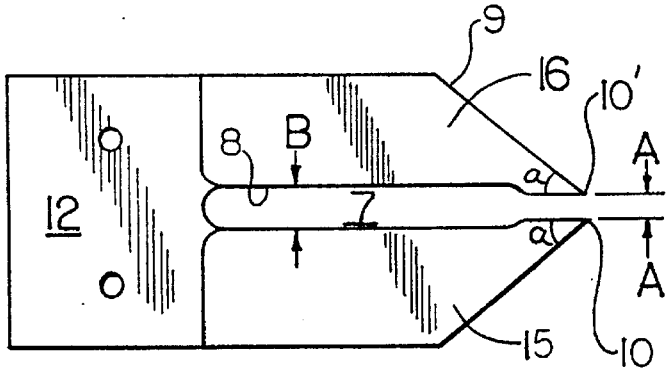
FIG. 2 is an elevated bottom view of the bristle finishing fork according to FIG. 1.
Figure 3:
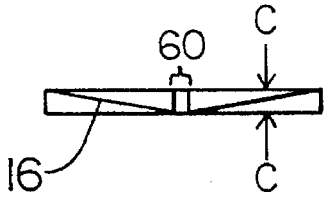
FIG. 3 is a end view of the bristle finishing fork of FIG. 1 when viewed from the tip.
Figure 4:
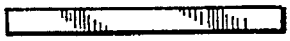
FIG. 4 is a end view of the bristle finishing fork of FIG. 1 when viewed from the base plate end.

FIG. 3 shows an end view from the tip of the bristle finishing fork of FIGS. 1 and 2. Prominently displayed are the lower surfaces 15 and 16 which slope away from the spaced A—A region 60. This sloping helps to displace bristles away from the finishing region and prevents their sliding back into the region. FIG. 4 shows an end view from the base plate. The thickness of these forks is typically greater than 0.5 mm and preferably should be about 2 mm.

Figure 5:
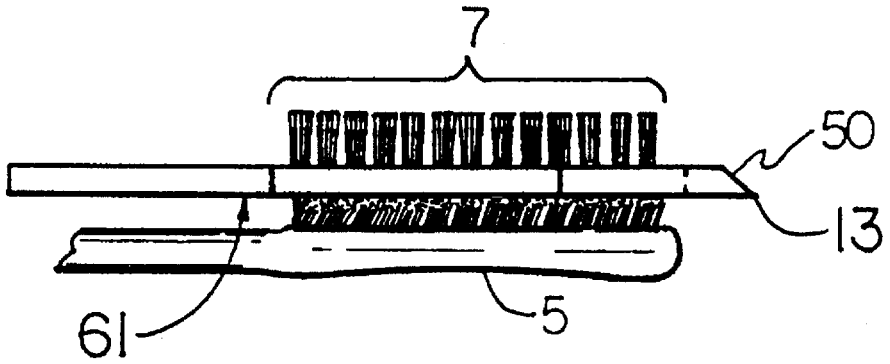
FIG. 5 is a left side view of the bristle finishing fork of FIG. 1 inserted into the bristles of a toothbrush. (The right side view is a mirror image of FIG. 5)

FIG. 5 is a left side view of the fork of FIG. 1. As can be seen, the brush side 61 (bottom) of the fork has a point 13 which extends in the direction of the brush. This point encounters the bristles first and is the initial separating means which directs non-isolated bristles away from the bristle finishing region 7.

Figure 6:
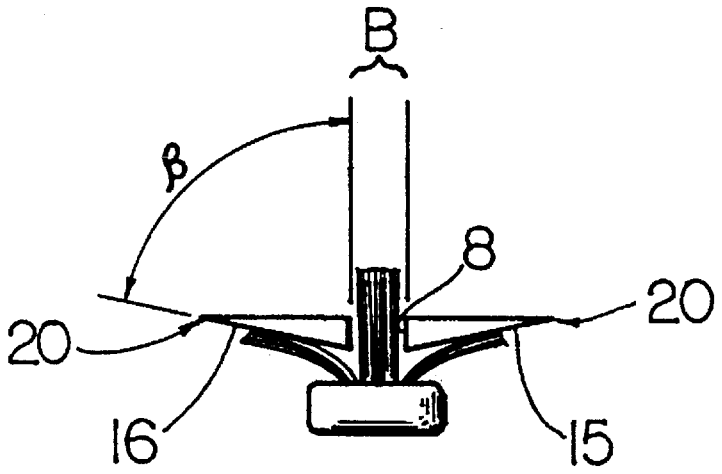
FIG. 6 is a cross-sectional view of the fork of FIG. 5 taken across section I—I of FIG. 1.

FIG. 6 is a cross-sectional view across lead lines I—I of FIG. 1. As can be seen, the prongs are preferably comprised of a lower surfaces 15 and 16 for preventing plowed bristles from slipping into the bristle finishing region 7(defined here by spacing "B"). The lower surfaces 15 and 16 intersects the inner blade edge surface 8 to form an acute angle β when viewed from the tip. Applicants have found that an acute angle of about 75 degrees provides the best plowing and retaining results.

In the FIGS. 7 through 14, the device according to the invention mainly consists of a bristle finishing fork 1 which is fixed on a carriage, slide or similar means whereby this slide 30 can move in a parallel motion relative to the fork and the bristles to be isolated 40 (shaded). Applicants concede that said carriage, slide or similar means can be actuated by any mechanical means known in the art, such as, for example, by way of a pneumatic drive, a magnetic drive, springs, mechanical cam, etc. Furthermore, in the alternative, the fork could be stationary and the brush could be moved in and out.

Positioned in front of the fork 1, a support 41 is provided for, on which suitable clamping means 42 and 43 are mounted, which serve the purpose of suitably clamping a brush body 31 against a thrust block with respect to the fork 1, whereby, in the present case, the brush body has a region of bristles to be isolated 40 (shaded) and regions of bristles to be displaced 44 and 45.

Figure 7:
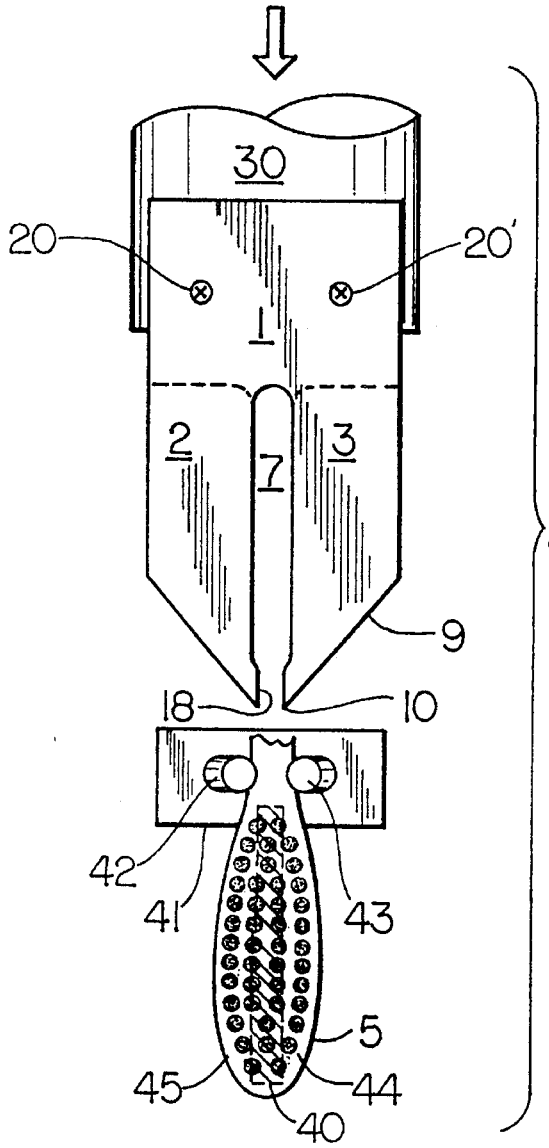
FIG. 7 is a schematic view from above of a device according to the present invention.
Figure 8:
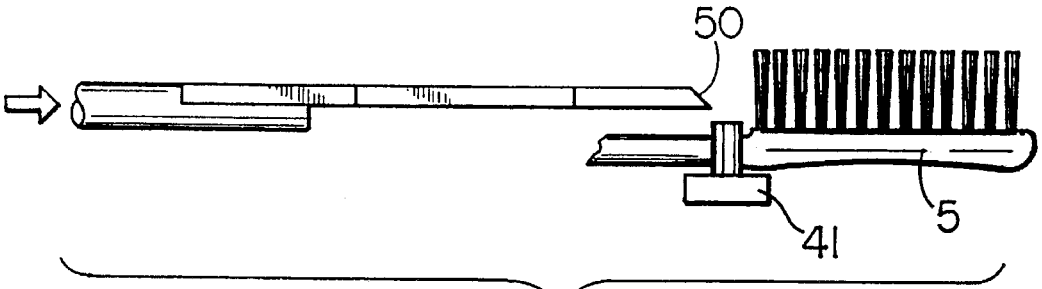
FIG. 8 is a side view of the device of FIG. 7.
Figure 9:
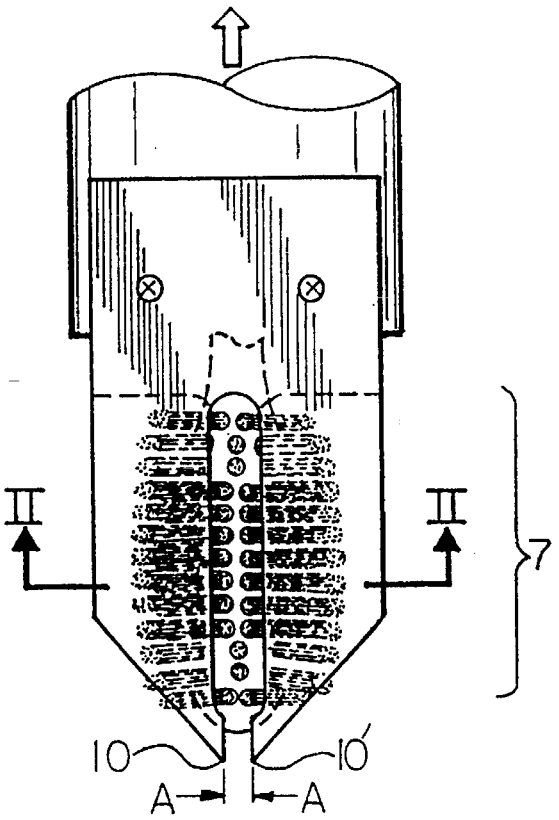
FIG. 9 is a view similar to the one of FIG. 7, but in a second characteristic position.
Figure 10:
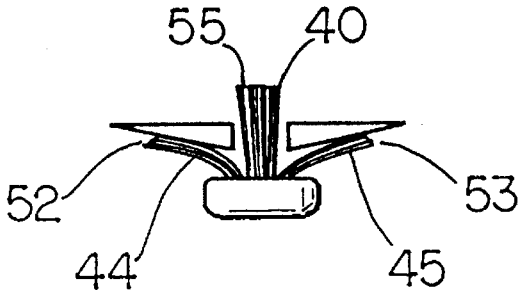
FIG. 10 is a cross-sectional view of Section II—II of FIG. 9. This view shows the deflection of non-isolated bristles.

The prongs 2 and 3 show at their front end a slanting face tip 50 and 50', in order to aid the prongs' movement from the position as in FIG. 7 to the position as in FIG. 9. The outer bristles 44 and 45, are displaced through the penetration of the prongs between the regions 44/40 and 45/40, as is clearly shown in FIGS. 10 and 11. These outer bristles are pushed towards the outside, whereby the prongs have a width which is such that the tops 52 and 53 of the rows of brush hairs 44 and 45 will be brought to a lower level than the tops 55 of the bristles in the region to be isolated 40.

In the position according to FIG. 7 the various brush hairs are in their normal state, whereby it is enough to move the slide 30 in any suitable way so that the prongs 2 and 3 move toward the brush body whereby one obtains that the slanting faces 50, 16 and 17 of the knives shall exert an action on the nonisolated bristles 44 and 45 whilst, due to the vertical inner face 8 of the prongs, the adjacent bristles 40 will not be influenced. The displaced bristles 44 and 45 are maintained in the displaced position by the action of lower surfaces 15 and 16.

The slanting face at the tip 50 and 50' and at the lower surface 16 and 17 are made in such a way that the tip of the prong 13 exactly penetrates between the bristles at the base of these bristles, whereby the separation of the bristles is made easier. Preferably, this penetration occurs at a transition point between bristles of different height; thus, retaining the original contour of the bristle trim pattern.

When the fork is engaged within the brush section, as in FIG. 9, the tips 10 and 10' of the prongs are separated at a distance A. This distance between the prongs defines the minimum width of the bristle swath to be isolated 40. As the fork continues into the penetration of the head, the isolated bristles 40 slide into the bristle finishing region 7. As can be seen from the Figures, the penetration region 7 is wider and slightly longer than the actual displacement of the bristles in the head. This provides for superior bristle finishing characteristics when the bristles are finished in an end rounding operation. End rounding operations involve grinding or abrading the ends of the bristles to form a rounded appearance. For further discussion of end roundedness, and the characteristic determinations used to quantify such, please see: Silverstone & Featherstone, Examination of the End Rounding Pattern of Toothbrush Bristles, Gerodontics, 4:2, pp 45–62 (1988); Nygaard-Ostby et al, Access to Interproximal Tooth Surfaces by Different Bristle Designs and Stiffnesses of Toothbrushes, Scand. J. Dent. Res., 87:424–430 (1979); and Breitenmoser et al., Damaging Effects of Toothbrush Bristle End Form of Gingiva, J. Periodontol., 50(4), pp. 212–216 (April 1979), all incorporated herein by reference.

Figure 11:
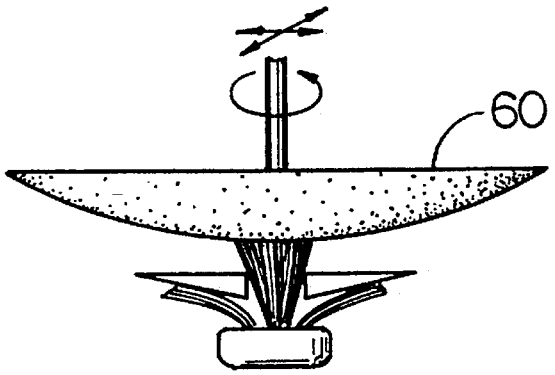
FIG. 11 is a view similar to the one of FIG. 10, but depicting an orbital grinder finishing the ends of the isolated bristles.

End rounding/abrasion processing is typically accomplished by use of eliptic orbital grinders like those described in U.S. Pat. No. 3,451,173 to Hazelton, issued Jun. 24, 1969, incorporated herein by reference, or by way of belt or drum sanders. Preferably, rotating belt grinders are used in conjunction with the present invention as shown in FIG. 11. As can be seen, the orbital grinder 60 is brought into contact with the tips 55 of the isolated bristles 40 thus causing them to oscillate, orbit and move liberally within the bristle finishing region 7.

Figure 12:
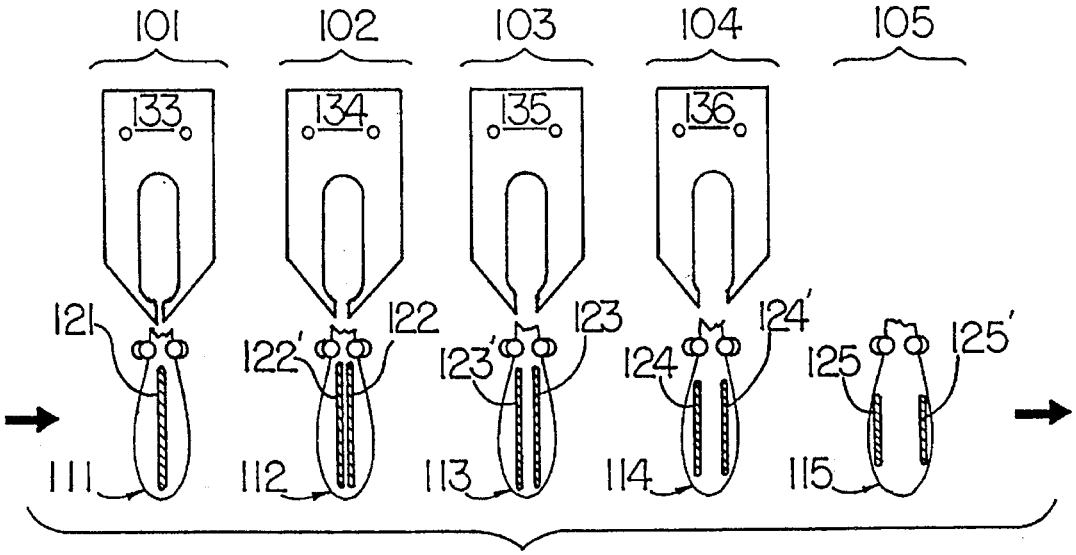
FIG. 12 shows a schematically and top-elevational view of the various stages of the production on only one machine of a toothbrush with bristles trimmed to five different heights.
Figure 13:
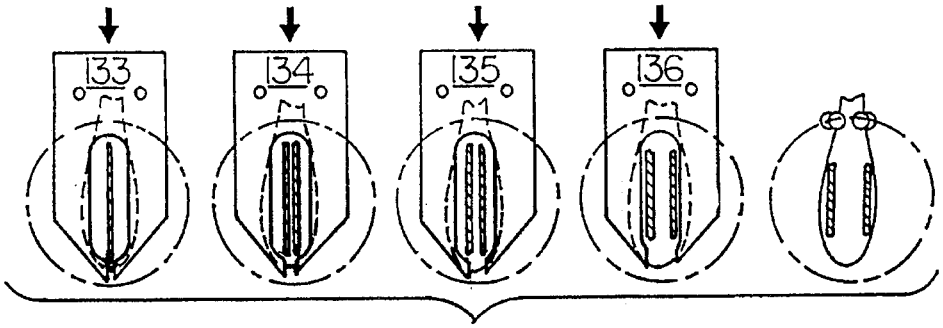
FIG. 13 is a view similar to the one of FIG. 12, but in a second characteristic position. During this phase of the processing the forks are engaged and an orbital grinder is used to round the ends of the bristles which have been isolated. The orbital grinder is depicted by the "-.-" line.
Figure 14:
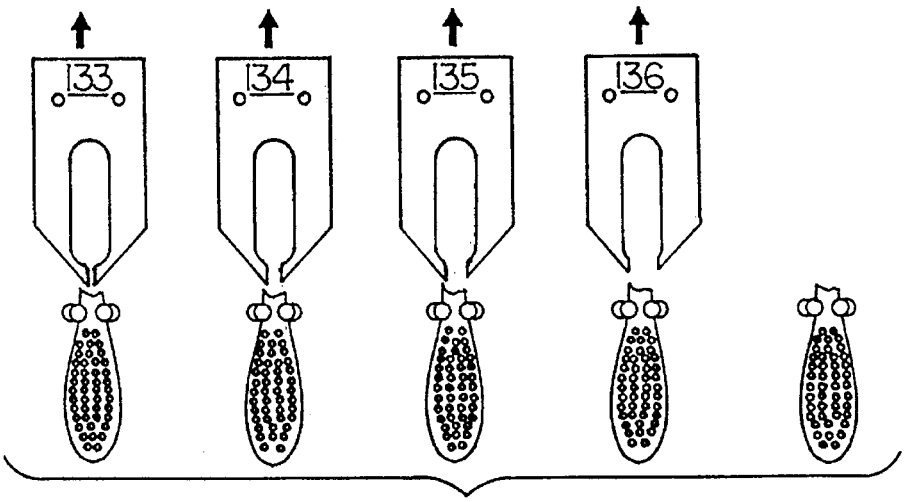
FIG. 14 is a view similar to the one of FIGS. 12 and 13 but in a third characteristic position. In this position the forks are disengaged and the bristles are free to move into the next index position.

FIGS. 12, 13 and 14, there is schematically shown how the device according to the invention can be used in order to further treat the brush bristles after tufting same whereby it should be noted that tufting brush hairs of different lengths is generally done by conveying bristles of different lengths from two containers or by trimming them in place using multiple trimming operations.

In FIGS. 12, 13 and 14 are schematically shown the five work stations, 101, 102, 103, 104 and 105, respectively whereby in stations 101, 102, 103 and 104 the bristle finishing fork is used to isolate particular bristles according to the present invention. As can be shown in FIG. 12, the brush heads 111, 112, 113, 114 and 115 are indexed into position within each work station. The regions which will be isolated and rounded at each work station are shown in shading 121, 122, 122', 123, 123', 124, 124', 125 and 125'.

The critical dimensions of the processing forks are depicted in the following table:

| | Distance A | Distance B |
|---|---|---|
| Fork 133 | 1.4 mm | 4 mm |
| Fork 134 | 2.1 mm | 4 mm |
| Fork 135 | 2.8 mm | 4 mm |
| Fork 136 | 3.5 mm | 4 mm |

Optionally, the distances A and B can be proportional. Thus the dimensions depicted above can be modified as follows:

| | Distance A | Distance B |
|---|---|---|
| Fork 133 | 1.4 mm | 2.9 mm |
| Fork 134 | 2.1 mm | 3.6 mm |
| Fork 135 | 2.8 mm | 4.3 mm |
| Fork 136 | 3.5 mm | 5.0 mm |

FIG. 13 schematically shows the next stage in the processing scheme whereby forks 133, 134, 135 and 136 are brought into engagement with the bristles thus plowing the bristles outside the shaded regions away from bristle finishing region 7, Once the fork and bristles have been engaged and the isolated bristles (121, 122, 122', 123, 123', 124, 124', 125, & 125')are positioned within the finishing region, orbital grinders are brought into contact with the exposed bristle tips, see dotted circles over the processing region in FIG. 13.

FIG. 14 schematically depicts the final step in the processing scheme whereby the forks (133, 134, 135 & 136) are disengaged from the bristle region. From this point, the brushes are indexed into the next processing step whereby brushhead 111 is moved into workstation 102, brushhead 112 is moved into workstation 102, brushhead 113 is moved into workstation 104, brushhead 114 is moved into workstation 105, and brushhead 115 goes on to packaging.

Figure 15:
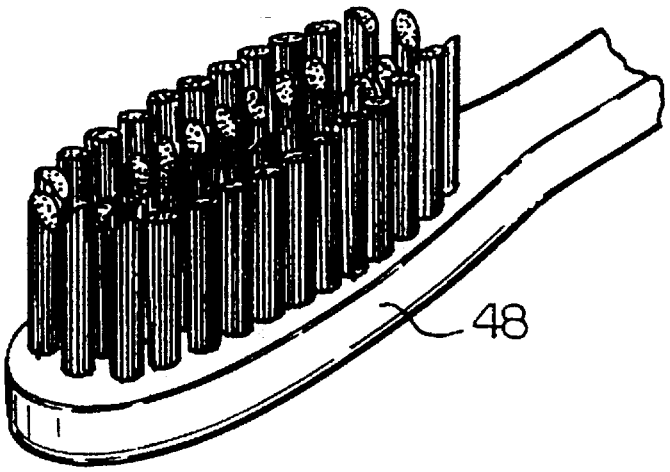
FIG. 15 shows the toothbrush produced by the process depicted in FIGS. 12, 13 and 14.

FIG. 15 depicts the toothbrush head 48 produced by the process according to the diagrams of FIGS. 12 and 14. It is interesting to note that the slight incremental widening of the A spacing with each progressive end-rounding on the depicted V-trim bush retains the V-like groove in the brush.

It is clear that the present invention is not at all limited to the embodiment described as in example and shown in the attached drawings, but that a such like device can be carried into effect in various shapes and dimensions without going outside the frame of the invention. For example, fork penetration need not be from the handle end as depicted in the figures. Alternatively, the fork penetration could be from the non-handle end or at any angle relative to the head.

What is claimed is:

1. A bristle finishing fork for isolating bristles affixed to a toothbrush head within a bristle finishing region comprising a planar base plate which is furcated into at least two elongated prongs having tips spaced at a distance "A" defining the width of the bristle swath to be isolated, wherein starting at said tip, the distance between the prongs increases to a distance "B" defining the sidewall of the bristle finishing region.

2. A bristle finishing fork according to claim 1 wherein said prongs are further comprised of inner blade edge surfaces which face one another and outer blade edge surfaces.

3. A bristle finishing fork according to claim 2 wherein said inner blade edge surfaces are comprised of a penetration region proximal to said tip and a bristle finishing region distal to said tip.

4. A bristle finishing fork according to claim 3 wherein said penetration and finishing regions of each said inner blade edge surface are generally parallel and are connected by way of an arcing transition.

5. A bristle finishing fork according to claim 2 wherein the inner blade edge surface and the outer blade edge surface intersect at the tip to form an acute angle.

6. A bristle finishing fork according to claim 5 wherein the inner blade edge surface and the outer blade edge surface intersect at the tip to form an angle of about 50°.

7. A bristle finishing fork according to claim 5 wherein said prongs are further comprised of a lower surface for preventing ploughed bristles from slipping into said bristle finishing region.

8. A bristle finishing fork according to claim 7 wherein said lower surface intersects said inner blade edge surface to form an acute angle when viewed from the tip.

9. A bristle finishing fork according to claim 8 wherein said lower surface intersects said inner blade edge surface to form an angle of about 75° when viewed from the tip.

10. A device for isolating and end-rounding bristles affixed to a toothbrush head within a bristle finishing region comprising:

(a) a means for holding a toothbrush with bristles affixed thereto; and (b) a bristle finishing fork comprising a planar base plate which is furcated into at least two elongated prongs having tips spaced at a distance "A" defining the width of the bristle swath to be isolated, wherein starting at said tip, the distance between the blades increases to a distance "B" defining the sidewall of the bristle finishing region, whereby said fork has a backwards and forwards motion, in such a way that the tip of said prongs can be introduced between toothbrush bristles through a parallel relative motion between fork and brush, so that the swath of bristles to be isolated are positioned in said bristle finishing region; and (c) a means for rounding the distal ends of the bristles positioned in said bristle finishing region.

11. A device for isolating and end-rounding bristles affixed to a toothbrush head according to claim 10 characterized in that the isolated bristles are of a length which is different from that of the bristles located outside the bristle finishing region.

12. A device for isolating and end-rounding bristles affixed to a toothbrush head according to claim 11 wherein said prongs are further comprised of inner blade edge surfaces which face one another and outer blade edge surfaces.

13. A device for isolating and end-rounding bristles affixed to a toothbrush head according to claim 12 wherein the inner blade edge surface and the outer blade edge surface intersect at the tip to form an acute angle.

14. A device for isolating and end-rounding bristles affixed to a toothbrush head according to claim 13 wherein said prongs are further comprised of a lower surface for preventing ploughed bristles from slippin into said bristle finishing region.

15. A device for isolating and end-rounding bristles affixed to a toothbrush head according to claim 14 wherein said lower surface intersects said inner blade edge surface to form an acute angle when viewed from the tip.

16. A device for isolating and end-rounding bristles affixed to a toothbrush head according to claim 15 characterized in that the said fork is fixed on a slide.

17. A device for isolating and end-rounding bristles affixed to a toothbrush head according to claim 15 characterized in that the said means for holding a toothbrush is fixed on a slide.

18. A method for isolating and end-rounding bristles affixed to a toothbrush head comprising the steps of:

(1) providing a device for isolating and end-rounding bristles affixed to a toothbrush head within a bristle finishing region comprising:

(a) a means for holding a toothbrush with bristles affixed thereto; and (b) a bristle finishing fork comprising a planar base plate which is furcated into at least two elongated prongs having tips spaced at a distance "A" defining the width of the bristle swath to be isolated, wherein starting at said tip, the distance between the blades increases to a distance "B" defining the sidewall of the bristle finishing region, whereby said fork has a backwards and forwards motion, in such a way that the tip of said prongs can be introduced between toothbrush bristles through a parallel relative motion between fork and brush, so that the swath of bristles to be isolated are positioned in said bristle finishing region; and (c) a means for rounding the distal ends of the bristles positioned in said bristle finishing region;

(2) engaging a toothbrush with a plurality of bristles affixed to the head within said means for holding a toothbrush;

(3) introducing said fork between the toothbrush bristles; and (4) rounding the distal ends of the bristles positioned in said bristle finishing region.

19. A method according to claim 18 further comprising the steps:

(5) providing an second device for isolating and end-rounding bristles affixed to a toothbrush head within a bristle finishing region comprising:

(a) a means for holding a toothbrush with bristles affixed thereto; and (b) a bristle finishing fork comprising at least two elongated prongs having tips spaced at a distance "A" defining the width of the bristle swath to be isolated, wherein starting at said tip, the distance between the blades increases to a distance "B" defining the sidewall of the bristle finishing region, whereby said fork has a backwards and forwards motion, in such a way that the tip of said prongs can be introduced between toothbrush bristles through a parallel relative motion between fork and brush, so that the swath of bristles to be isolated are positioned in said bristle finishing region and whereby distance "A" of this fork is different that distance "A" of step (1); and (c) a means for rounding the distal ends of the bristles positioned in said bristle finishing region;

(6) engaging a toothbrush with a plurality of bristles affixed to the head within means for holding a toothbrush in said second device;

(7) introducing said fork between the toothbrush bristles in said second device; and (8) rounding the distal ends of the bristles positioned in said bristle finishing region of said second device.

* * * * *